US012037877B1

(12) United States Patent
Fripp et al.

(10) Patent No.: US 12,037,877 B1
(45) Date of Patent: Jul. 16, 2024

(54) REMOVABLE COVERS FOR MAGNETIC SCALE INHIBITORS

(71) Applicant: Halliburton Energy Services, Inc., Houston, TX (US)

(72) Inventors: Michael Linley Fripp, Singapore (SG); Srividhya Sridhar, Houston, TX (US); Stephen Michael Greci, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/197,385

(22) Filed: May 15, 2023

(51) Int. Cl.
*E21B 41/02* (2006.01)
*E21B 34/06* (2006.01)
*E21B 37/00* (2006.01)

(52) U.S. Cl.
CPC ..... *E21B 41/02* (2013.01); *E21B 34/063* (2013.01); *E21B 37/00* (2013.01)

(58) Field of Classification Search
CPC ..... E21B 41/02; E21B 34/14; E21B 34/063; E21B 37/00
See application file for complete search history.

(56) References Cited

U.S. PATENT DOCUMENTS

| | | | | |
|---|---|---|---|---|
| 5,052,491 | A | 10/1991 | Harms et al. | |
| 7,353,873 | B2 | 4/2008 | Borst et al. | |
| 7,357,862 | B2 * | 4/2008 | White | C02F 1/481 210/194 |
| 8,414,776 | B2 * | 4/2013 | Hale | E21B 37/00 204/557 |
| 10,077,634 | B2 | 9/2018 | Perio, Jr. | |
| 2015/0147495 | A1 | 5/2015 | Kumar et al. | |
| 2017/0051576 | A1 | 2/2017 | Perio, Jr. | |
| 2019/0112883 | A1 | 4/2019 | McKenzie | |

FOREIGN PATENT DOCUMENTS

| | | |
|---|---|---|
| CN | 204252956 U | 4/2015 |
| WO | 2022081154 A1 | 4/2022 |

OTHER PUBLICATIONS

Filing Receipt, Specification and Drawings for U.S. Appl. No. 18/173,639, entitled "Magnetic Inflow Control Device to Inhibit Scale Production in a Wellbore," filed Feb. 23, 2023, 29 pages.
Foreign Communication from Related Application—International Search Report and Written Opinion of the International Searching Authority, International Application No. PCT/US2023/023184, dated Feb. 14, 2024, 9 pages.

* cited by examiner

*Primary Examiner* — Dany E Akakpo
(74) *Attorney, Agent, or Firm* — Conley Rose, P.C.; Rodney B. Carroll

(57) ABSTRACT

A magnet shield for use with a magnetic scale inhibitor includes a barrier configured for positioning at a location between the magnetic scale inhibitor and a flowbore for at least a first time period. The flowbore is configured for flow of a fluid. The barrier is: degradable in the fluid, such that, after the first time period, the barrier is no longer present at the location; and/or shiftable, such that, after the first time period, the barrier can be shifted away from the location. During the first time period, the barrier reduces or eliminates attraction of ferromagnetic particles to magnets of the magnetic scale inhibitor. A magnetic scale inhibitor assembly comprising the magnet shield and a methods of utilizing the magnet shield and the magnetic scale inhibitor assembly comprising the magnet shield are also provided herein.

20 Claims, 8 Drawing Sheets

REMOVABLE COVERS FOR MAGNETIC SCALE INHIBITORS

FIELD

This disclosure relates generally to the field of scale mitigation in hydrocarbon production from a wellbore. More particularly, this disclosure relates to the field of inhibiting scale production with a magnet. Still more particularly, this disclosure relates to inhibiting scale production with a magnetic scale inhibitor assembly comprising a removable/temporary shield.

BACKGROUND

Fluids produced from a subsurface formation may contain water. Ions dissolved in the water may come out of solution to form scale on wellbore equipment (such as tubing, flow control devices, etc.) as the water flows from the subsurface formation to the wellbore, and ultimately to the surface. As scale forms on downhole equipment, the scale may restrict and/or obstruct the flow path of the fluids flowing to the surface. The scale may also damage downhole equipment, leading to possible intervention operations. Often, it is desirable to inhibit the production of scale to avoid restricting the flow of the fluid produced from the subsurface formation and damaging downhole equipment. A magnetic scale inhibitor can be utilized to inhibit the formation of scale during production of fluids from the well. However, during startup or cleaning runs, it is undesirable to collect ferromagnetic material (e.g., swarf) on magnets of the magnetic scale inhibitor.

BRIEF DESCRIPTION OF THE DRAWINGS

Embodiments of the disclosure may be better understood by referencing the accompanying drawings.

DESCRIPTION

Figure 1A:
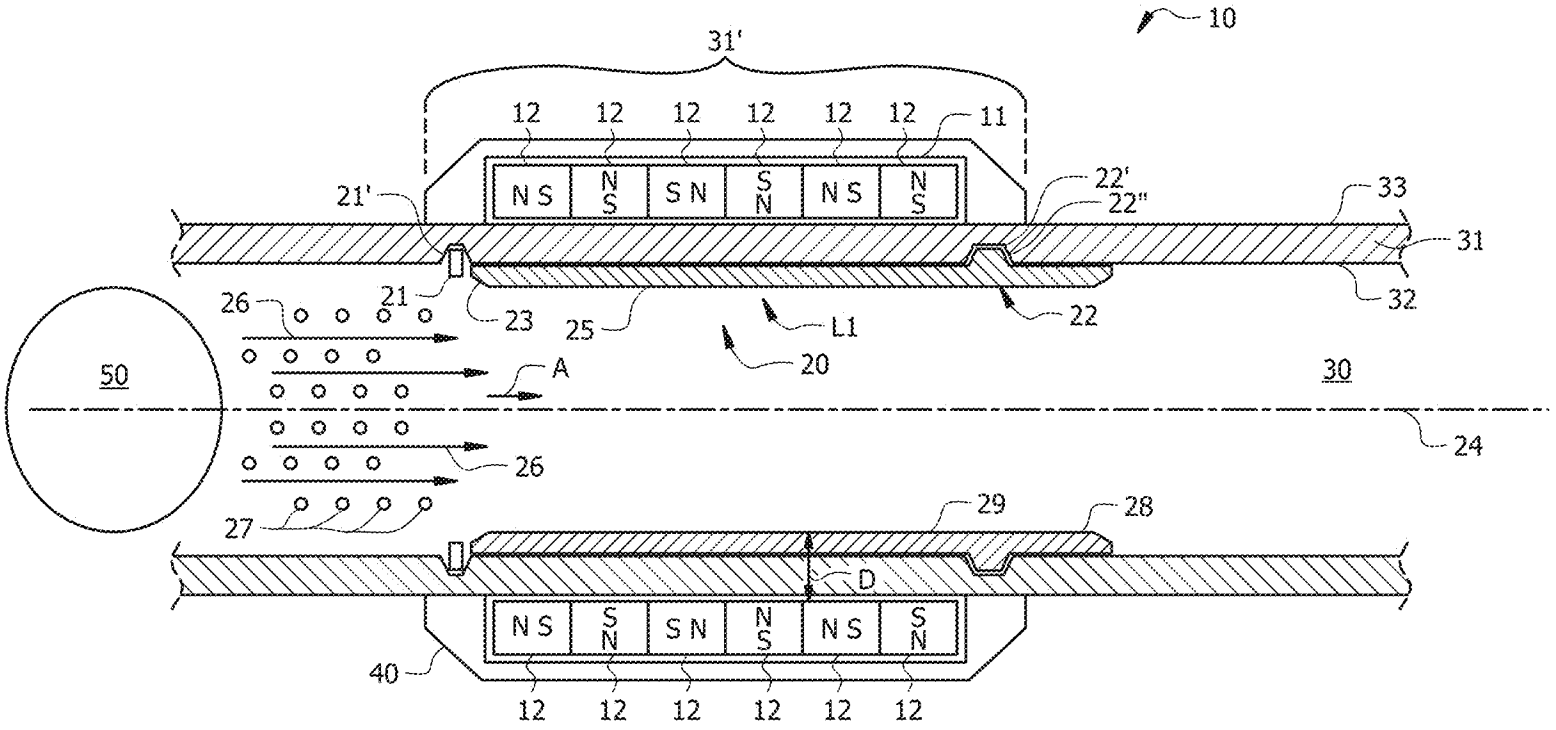
FIG. 1A is a schematic of a magnetic scale inhibitor assembly, according to embodiments of this disclosure.

The description that follows includes example systems, methods, techniques, and program flows that embody aspects of the disclosure. However, it is understood that this disclosure may be practiced without these specific details. For instance, this disclosure provides a magnetic scale inhibitor assembly that can be positioned within a production tubing or upstream therefrom (e.g., in an inflow tube or path of a flow control device). Although specific magnetic scale inhibitor assemblies comprising various arrangements of magnets are utilized to describe the embodiments of this disclosure, it is to be understood that aspects of this disclosure include other configurations of a magnetic scale inhibitor (e.g., other arrangements of magnets and/or positioning thereof), so long as the magnetic scale inhibitor assembly is adapted to utilize a (e.g., degradable and/or shiftable) shield, as detailed hereinbelow. For brevity, well-known steps, protocols, structures, and techniques have not been shown in detail in order not to obfuscate the description.

Example embodiments relate to inhibition of the production of scale in a tubular string positioned in a wellbore formed in a subsurface formation. In some embodiments, a flow control device may be positioned on the tubular string, such that fluid produced from the subsurface formation flows into the tubular string via the flow control device. In some embodiments, the flow control device may be configured with a flow restrictor that restricts the flow of fluid into the tubular string, thus increasing the flow velocity as the fluid flows through the flow control device. For example, the flow restrictor of a flow control device may include an inflow tube, a vortex, a fluidic diode, a nozzle, a Tesla valve, a fluidic oscillator, a static mixer, a steam valve, a puck, etc. In some embodiments, a magnetic scale inhibitor assembly of this disclosure can be positioned proximate the (e.g., flow restrictor of a) flow control device to inhibit the production of scale as fluid flows into the tubular string. For example, the magnetic scale inhibitor assembly can be positioned proximate a flow restrictor within an inflow control device (ICD), an autonomous inflow control device (AICD), an inflow control valve (ICV), or the like, whereby fluid flow restriction provided by the flow restrictor may result in an increase in the velocity of the fluid. A fast flow velocity can have the potential to better inhibit scale formation as fluid flows near one or more magnets of the magnetic scale inhibitor assembly, in a second configuration thereof (described further hereinbelow). The flow velocity can be increased to achieve greater scale inhibition without interfering with fluid production.

Magnetic scale inhibitors can utilize a magnetic field to inhibit the production of scale. Such magnetic field can, however, become clogged by metal particles, for example, during wellbore installation and/or cleanup. Provided herein is a magnet shield and a magnetic scale inhibitor assembly that employs such a magnet shield for protecting one or more magnet(s) of the magnetic scale inhibitor of the magnetic scale inhibitor assembly from ferromagnetic particles during the early life of the wellbore.

Figure 1B:
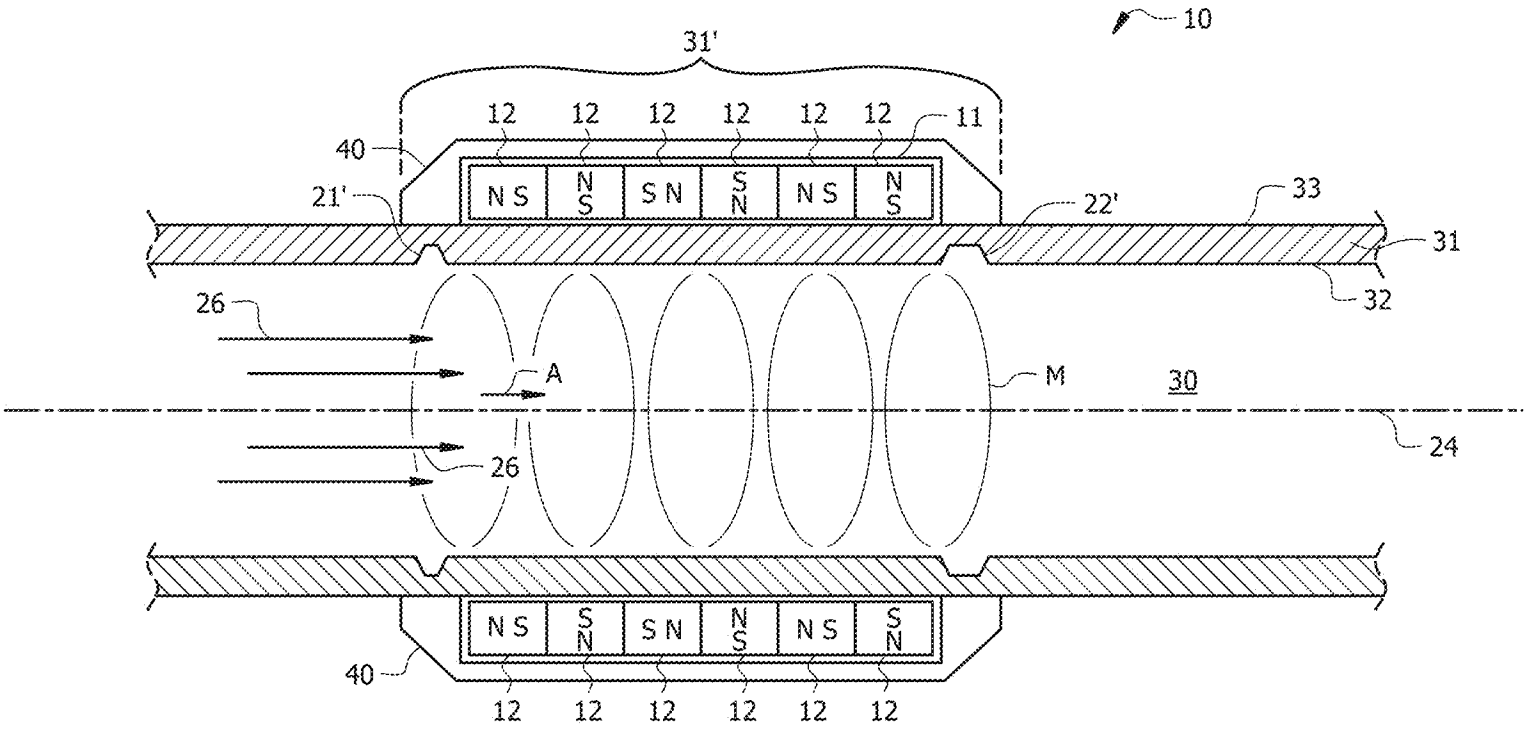
FIG. 1B is a schematic of a magnetic scale inhibitor assembly of this disclosure after a first time period, according to embodiments of this disclosure.
Figure 1C:
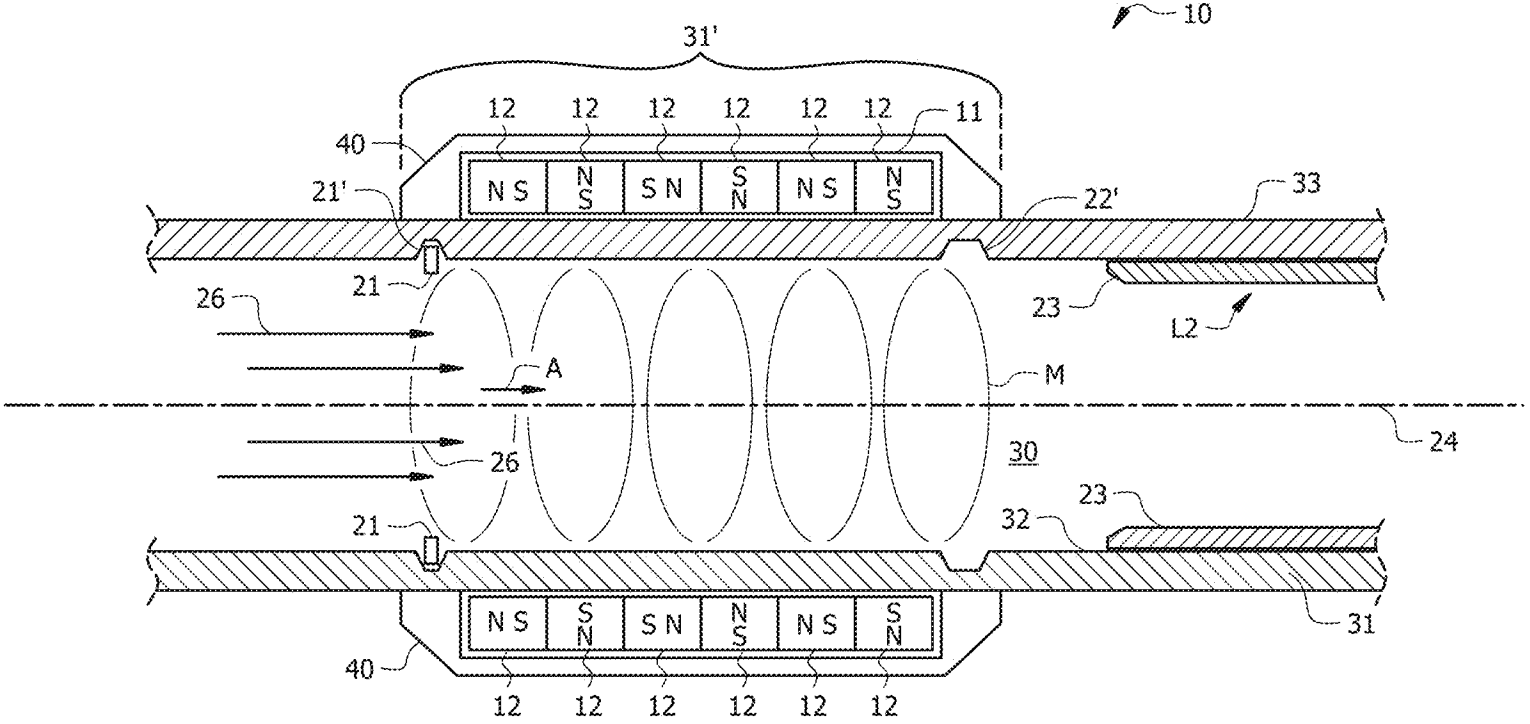
FIG. 1C is a schematic of a magnetic scale inhibitor assembly after a first time period, according to other embodiments of this disclosure.

As noted hereinabove, disclosed herein is a magnet shield for use with a magnetic scale inhibitor. The magnet shield and a magnetic scale inhibitor assembly comprising the magnet shield and a magnetic shield inhibitor will now be described with reference to FIGS. 1A-1C. FIG. 1A is a schematic of a magnetic scale inhibitor assembly 10, according to embodiments of this disclosure; FIG. 1B, is a schematic of a magnetic scale inhibitor assembly 10 of this disclosure after a first time period, according to embodiments of this disclosure; and FIG. 1C is another schematic of a magnetic scale inhibitor assembly 10 after the first time period, according to embodiments of this disclosure. As described further hereinbelow, after the first time period t1, the magnetic scale inhibitor assembly 10 comprises a magnetic scale inhibitor 40 without the magnet shield 20 positioned between the one or more magnets 12 and a fluid flowbore 30, as the magnet shield 20 has, after time period t1, degraded or shifted away.

The magnet shield 20 of this disclosure can comprise a barrier 25 configured for positioning, for at least a first time period, at a location (or "position") generally depicted in FIG. 1A as L1 between a magnetic scale inhibitor 40 and a fluid flowbore 30 (also referred to herein simply as a "flowbore" 30). The fluid flowbore 30 is configured for flow of a fluid (indicated in FIG. 1A as fluid 26). As depicted in FIG. 1B, in embodiments, the barrier 25 is degradable in the fluid 26, such that, after the first time period, the barrier 25 is no longer present at the location L1. In embodiments, such as depicted in FIG. 1C, the barrier 25 is movable/shiftable, such that, after the first time period, the barrier 25 can be shifted away from the location (or "position") L1 to a second location (or "position") generally depicted in FIG. 1C as L2. In embodiments, the barrier 25 can be both degradable and shiftable, such that, should the barrier 25 not adequately degrade during time period t1, the barrier 25 can be shifted away from position or location L1. During the first time period t1, the barrier 25 reduces or eliminates attraction of ferromagnetic particles 27 in the flowing fluid 26 to (e.g., an array 11 of) magnets 12 of the magnetic scale inhibitor 40.

In embodiments, magnet shield 20 (e.g., barrier 25 thereof) does not create a pressure barrier (e.g., is not a dissolvable pressure sleeve). For example, in embodiments, magnet shield 20 does not comprise seals (e.g., as would typically be utilized in a pressure barrier). Alternatively, in embodiments, the magnet shield 20 can, in embodiments, comprise seals and/or serve as a pressure barrier.

For simplicity, lines of magnetic field/flux are generically depicted as lines M in the figures. Effective scale reduction can be provided by strong magnetic fields M in the fluid 26. However, as noted hereinabove, these strong magnetic fields M can also attract ferromagnetic particles 27 in the fluid 26, e.g., during the installation, cleanup, and early production. The ferromagnetic particles 27 may be ferromagnetic metal particles (e.g., swarf from casing wear, burrs from perforating, debris from drilling lateral junctions, chips from side tracking, and/or residue from drilling out zonal isolation from hydraulic fracturing, or the like), ferromagnetic metal oxide particles such as rust, and/or other ferromagnetic contaminant particles 27 in the fluid 26.

The strength of the magnetic field M decreases with distance from the magnet(s) 12. Experiments in flow loops with ferromagnetic powder 27 indicate that a standoff as small as ⅛" may be sufficient such that flow friction will overcome the attraction force from magnet(s) 12 and prevent buildup of the ferromagnetic particles 27 on the surfaces (e.g., inside surface 32 of flowbore wall 31 that provides flowbore 30) near the permanent magnet(s) 12. The magnetic field decreases with the square of the distance between the permanent magnet(s) 12 and the particles 27. The magnetic force, on the other hand, decreases with the distance to the fourth power. Thus, additional distance between the magnet(s) and the ferromagnetic particles 27 can dramatically decrease the magnetic force and allow the viscous forces of the flowing fluid 26 to clear the ferromagnetic particles 27 from the inside surface 32 of the flowbore wall 31. Accordingly, the barrier 25 (e.g., thickness thereof, etc.) can be designed to provide a desirable minimum possible distance D between ferromagnetic particles 27 in the fluid 26 and the one or more magnets 12 of the magnetic scale inhibitor 40. In embodiments, the distance D between ferromagnetic particles 27 in the fluid 26 and inside surface 32 of flowbore wall 31 is greater than or equal to about ⅛", ¼", ½", ¾", or 1 inch (3, 6, 12, 19, or 25 mm).

Barrier 25 is positioned between the one or more (e.g., one or a plurality of) magnets 12 of magnetic scale inhibitor 40 and flowbore 30. Barrier 25 can be positioned inside flowbore wall 31 that defines interior fluid flowbore 30. Flowbore wall 31 can be the wall of a production tubular (e.g., tubular 206, described in more detail hereinbelow with reference to of FIG. 3) of a tubular string (e.g., tubular string 106, as described further hereinbelow with reference to FIG. 2; also referred to herein as a "production string" 106) or the wall of an inflow tube upstream of the tubular string 106 (e.g., inflow tube 306 of FIGS. 4A/4B or 402 of FIG. 5, described in more detail hereinbelow). As detailed further hereinbelow, barrier 25 can comprise a cylindrical sleeve 28 positioned on inside surface/interior diameter 32 of production tubular (e.g., 206 of FIG. 3) of a tubular string (e.g., tubular string 106 of FIG. 2) or an inside surface/interior diameter 32 of an inflow tube upstream of the tubular string (e.g., inflow tube 306 of FIG. 3 or 402 of FIGS. 4A/4B).

The magnet shield 20 can further comprise an affixing component 21 operable to hold the barrier 25 (e.g., a cylindrical sleeve 28 providing barrier 25 in place (for example, on flowbore wall 31 of the production tubing or the inflow tube)). The affixing component 21 can be selected from snap rings, collets, set screws, adhesives, shear pins, liners providing the cylindrical sleeve on the flowbore wall 31, or a combination thereof. Other suitable affixing components 21 will be apparent to those of skill in the art and with the help of this disclosure. For example, a snap ring affixing component 21 can be positioned in a cavity 21' along inside surface 32 of flowbore wall 31, and/or an extension 22" of magnet shield 20 can be positioned in a cavity 22' along inside surface 32 of flowbore wall 31, to hold magnet shield 20 in position at location L1. Affixing component(s) 21 can also degrade and/or otherwise be removed after time period t. For example, upon degradation of magnet shield 20, affixing component 21 may wash away with flow of fluid 26, as depicted in FIG. 1B. Alternatively or additionally, shifting of magnet shield 20 can also shift, break, or otherwise remove affixing component(s) 21. Alternatively, as depicted in FIG. 1C, affixing component 21 may remain when the remainder of magnet shield 20 washes or shifts away from location L1. In embodiments, affixing component(s) 21 remain in position subsequent time period t1, so long as the presence thereof at location L1 does not interfere with the scale inhibiting performance of magnetic scale inhibitor 40.

As noted hereinabove, in embodiments, barrier 25 is degradable. Barrier can be degradable via any number of avenues. For example, in embodiments, barrier 25 can be degradable via dissolution, via hydrolysis, via (e.g., cracking and) breaking into pieces and flowing with the fluid 26 (e.g., in direction A, such that the pieces are removed from location L1), via chemical reaction, or a combination thereof.

In embodiments, barrier 25 can comprise a material 29 selected from polymers, metals, ionic compounds, or a combination thereof. In embodiments, material 29 comprises a (e.g., degradable) polymer. Suitable degradable polymers can include, for example, degradable plastics (e.g., aliphatic polyesters, such as polyglycolic acid (PGA) and polylactic acid (PLA), acetate, polyvinyl alcohol (PVA), polyvinyl alcohol (PVOH), polylactic acid from L-lactide (PLLA)), degradable elastomers (e.g., polyurethane, thermoplastic urethane, thiol, natural rubber), sugars, or a combination thereof.

In embodiments, as noted above, the material 29 comprises a metal. In embodiments, material 29 comprises a metal selected from magnesium alloys, aluminum alloys, or a combination thereof. The metal can be doped with another metal to accelerate a rate of degradation of the barrier.

In embodiments, as noted above, the material 29 comprises an ionic compound, such as one or more ionic compounds selected from salts (e.g., sodium chloride (NaCl), sodium sulfate ($Na_2SO_4$), barium nitrate ($Ba(NO_3)_2$), borate-compounds, etc.).

In embodiments, the material 29 comprises one or more of polylactic acid (PLA), polyglycolic acid (PGA), polycaprolactone (PCL), polyvinyl alcohol (PVA), carboxymethyl cellulose (CMC), xanthan gum, hydroxypropyl guar (HPG), a starch-based material, a magnesium alloy, a zinc alloy, calcium carbonate, sodium bicarbonate, citric acid, hydrochloric acid, potassium chloride, or a combination thereof.

As noted hereinabove, in embodiments, the barrier 25 is shiftable or otherwise movable such that, subsequent the first time period t1, the barrier 25 can be moved out of position/location L1 and moved to a second position or location L2, in which second position or location L2, barrier 25 is no longer positioned (e.g., directly) between the one or more magnets 12 of magnetic scale inhibitor 40 and flowbore 30. The barrier 25 can be shiftable via a shifting device (depicted generically as 50 in FIG. 1A) selected from a dart, a ball, a shifting tool, or a combination thereof. The shifting can thus be effected by dropping a ball, activating a shifting tool, or the like.

Thus, alternatively or additionally to degradation, the protective magnet shield 20 can, in embodiments, be removed by shifting it away from the permanent magnet(s) 12 of the magnetic scale inhibitor 40. In some such embodiments, the protective magnet shield 20 can be constructed from a ferromagnetic material, such that substantially all of the magnetic flux M passes through the magnet shield 20 and none of the magnetic flux M passes into the interior flowbore 30 (e.g., of the production tubing 206 or inflow tube 306 (FIGS. 4A/4B)/402 (FIG. 5)). "All of the flux" can indicate that greater than 90% of the total magnetic flux that is external to the magnet 12 will pass through the magnet shield 20. "None of the magnetic flux" can indicate that less than 10% of the magnetic flux is in the flow area (e.g., of flowbore 30). In embodiments, the barrier 25 is shiftable, and the material 29 can be doped with a ferromagnetic material.

As noted hereinabove, in embodiments, barrier 25 can be degradable and shiftable.

In embodiments, the magnet shield 20 is shaped to enhance prevention of ferromagnetic particles 27 from sticking to the flowbore wall 31. For example, the magnet shield 20 can be designed to encourage turbulence in the flow of fluid 26 nearby, can promote speeding up of the flow of fluid 26 passing thereover (e.g., to dislodge any sticking particles 27), can promote pushing/directing of ferromagnetic particles 27 in the fluid 26 away from the flowbore wall 31, or a combination thereof. For example, in embodiments, a leading edge 23 of magnet shield 20 can be shaped to push particles 27 in fluid 26 toward a centerline 24 of flowbore 30.

In embodiments, barrier 25 is shiftable and can be shifted back to the location L1 for a second time period t2. In such embodiments, barrier 25 can be utilized, for example, for cleaning scale/detritus off the flowbore wall 30 proximate magnetic scale inhibitor 40 and/or during a cleanup run that produces swarf or other ferromagnetic particles 27 that can be attracted to flowbore wall 31).

The first time period t1 can be any time period during which ferromagnetic particles 27 are expected in fluid 26. For example, in embodiments, the first time period t1 is from about 1 hour to about 1 year (e.g., about 1 month).

Also provided herein is a magnetic scale inhibitor assembly 10 comprising: a magnetic scale inhibitor 40 comprising: one or a plurality of magnets 12 (e.g., one or more magnet arrays 11, each having one or more magnets 12) positioned proximate fluid flowbore 30. The one or the plurality of magnets 12 can be configured such that a magnetic flux/magnetic field (e.g., exemplary field lines labeled M in FIG. 6, and described further hereinbelow) produced by the one or the plurality of magnets 12 can be directed into (e.g., when magnet shield is not between flowbore 30 and the one or more magnets 12) or toward the fluid flowbore 30. Magnetic flux and/or field M can be referred to herein as magnetic flux/magnetic field M" or simply "magnetic flux M". As noted above, the fluid flowbore 30 is configured for flow of fluid 26. In a first configuration (e.g., as depicted in FIG. 1A) of the magnetic scale inhibitor assembly 10, magnet shield 20 comprising barrier 25 can be positioned at a location/position L1 between the one or the plurality of magnets 12 of the magnetic scale inhibitor 40 and the fluid flowbore 30 for at least a first time period t1, such that, during the first time period t1, the barrier 25 reduces or eliminates attraction of ferromagnetic particles 27 toward the one or the plurality of magnets 12/location L1 by reducing or eliminating an amount of the magnetic flux M extending into the flowbore 30. That is, during the first time period t1, the barrier 25/magnet shield 20 blocks the magnetic flux M produced by the one or the plurality of magnets 12 of the magnetic scale inhibitor 40 from reaching into flowbore 30 and attracting any ferromagnetic particles 27 in the fluid 26 thereto.

The barrier 25 is as described hereinabove, and can be degradable in the fluid 26, such that, after the first time period t1, the barrier 25 is no longer present at the location L1 in a second configuration (e.g., FIG. 1B) of the magnetic scale inhibitor assembly 10; and/or the barrier 25 can be shiftable/movable, such that, after the first time period t1, the barrier 25 can be shifted away from the location L1 in the second configuration (e.g., FIG. 1C) of the magnetic scale inhibitor assembly 10.

As mentioned hereinabove, and detailed hereinbelow with reference to FIGS. 3-6, in embodiments of the magnetic scale inhibitor assembly 10, the fluid flowbore 30 can comprise at least a portion of a flowbore 30 of a production tubular 206 (FIG. 3) of a tubular string 106 (FIG. 2) or a flowbore 30 of an inflow tube 306 (FIGS. 4A/4B)/402 (FIG. 5) upstream from a tubular string 106.

In embodiments, the inflow tube 306/402 is part of a flow control device 108' (e.g., of a production assembly 108, as described further with reference to FIG. 2 hereinbelow) upstream of the tubular string 106. The fluid flowbore 30 can comprise a fluid flowbore 30 of a restrictor of the flow control device 108'. The flow control device 108' can be configured to increase a flow velocity of the fluid 26 as the fluid 26 flows through the flow control device 108'. For example, in embodiments, the flow control device 108' can comprise a nozzle, a vortex, a Tesla valve, a fluidic oscillator, a puck, a static mixer, or a steam valve.

The magnetic scale inhibitor 40 is configured to create a magnetic field M through which the fluid 26 is to flow along the flowbore 30 when the magnetic scale inhibitor assembly 10 is in the second configuration of FIG. 1B or FIG. 1C (e.g., when the magnet shield 20 has degraded and/or shifted from location L1 and no longer blocks the magnetic field M from extending into flowbore 30).

As discussed further hereinbelow with reference to FIGS. 5 and 6, the magnetic field M can comprise an alternating magnetic field. The magnetic scale inhibitor assembly 10 can comprise one or a plurality of magnets 12 (and/or magnet arrays 11). The plurality of magnets 12 (and/or magnet arrays 11) can be positioned proximate at least a portion of a production tubing 206 of a tubular string 106 or a flow tube 306/402 (e.g., a flow restrictor) of a flow control device 108' upstream from the tubular string 106, as described further hereinbelow with reference to FIGS. 2-6.

As described further with reference to FIG. 6 hereinbelow, in embodiments, the plurality of magnets 12 can be positioned around a circumference (e.g., an outside circumference 33) of the at least the portion of the production tubing 206 or the flow tube 306/402 of the flow control device 108' in at least a partial Halbach array.

The magnetic scale inhibitor 40 is configured to generate a magnetohydrodynamic force in the fluid 26 as the fluid 26 flows through the flowbore 30 when the magnetic scale inhibitor assembly 10 is in the second configuration (e.g., of FIG. 1B, FIG. 1C). The fluid 26 can comprise dissolved ions that, in response to the magnetohydrodynamic force, are clustered/aggregated in the fluid 26 flow (e.g., in the direction indicated by arrow A in FIG. 1A) and thus do not gather along flowbore wall 31 defining flowbore 30.

As noted above, magnetic scale inhibitor 40 can comprise one or more magnets 12. In embodiments, the magnetic scale inhibitor 40 can be configured to create an alternating magnetic field M. The alternating magnetic field M created by the magnetic scale inhibitor 40 may, when the magnetic scale inhibitor is in the second configuration thereof, inhibit dissolved ions from coming out of solution (i.e., water from the subsurface formation 101) to form scale on equipment in the wellbore (such as a flow control device, the interior wall of the tubing of tubular string 106, etc.). For instance, the dissolved ions in the fluid may have a charge. The charged, dissolved ions may encounter a magnetohydrodynamic force (e.g., a Lorentz force), generated by the alternating magnetic field M, as the ions pass through the magnetic scale inhibitor assembly (in the second configuration thereof) via the fluid flow. As a result, the dissolved ions may cluster in the flow of the fluid 26 rather than attaching to the wellbore equipment, thus inhibiting the production of scale. For example, the magnetohydrodynamic force may encourage calcium carbonate ($CaCO_3$) to form aragonite, which may not attach to the equipment or may attach with sufficiently low adhesion strength such that the flow friction may remove the aragonite. In some instances, a similar effect may occur when the precipitate includes calcium sulfate ($CaSO_4$), barium sulfate ($BaSO_4$), etc. In some embodiments, an increase in velocity and/or an increase in the alternating magnetic field M may result in an increase in the magnetohydrodynamic force, thus improving the inhibition of scale production. Therefore, the magnetic scale inhibitor 40 may be positioned within a flow control device 108', in embodiments, to utilize the high flow velocity of the fluid 26 therein and increase the inhibition of scale production without interfering with the production of the fluid 26. By positioning magnetic scale inhibitor 40 within a flow control device 108', the inhibition of scale production can be near the subsurface formation 101 which may limit the locations in which scale may form.

Figure 2:
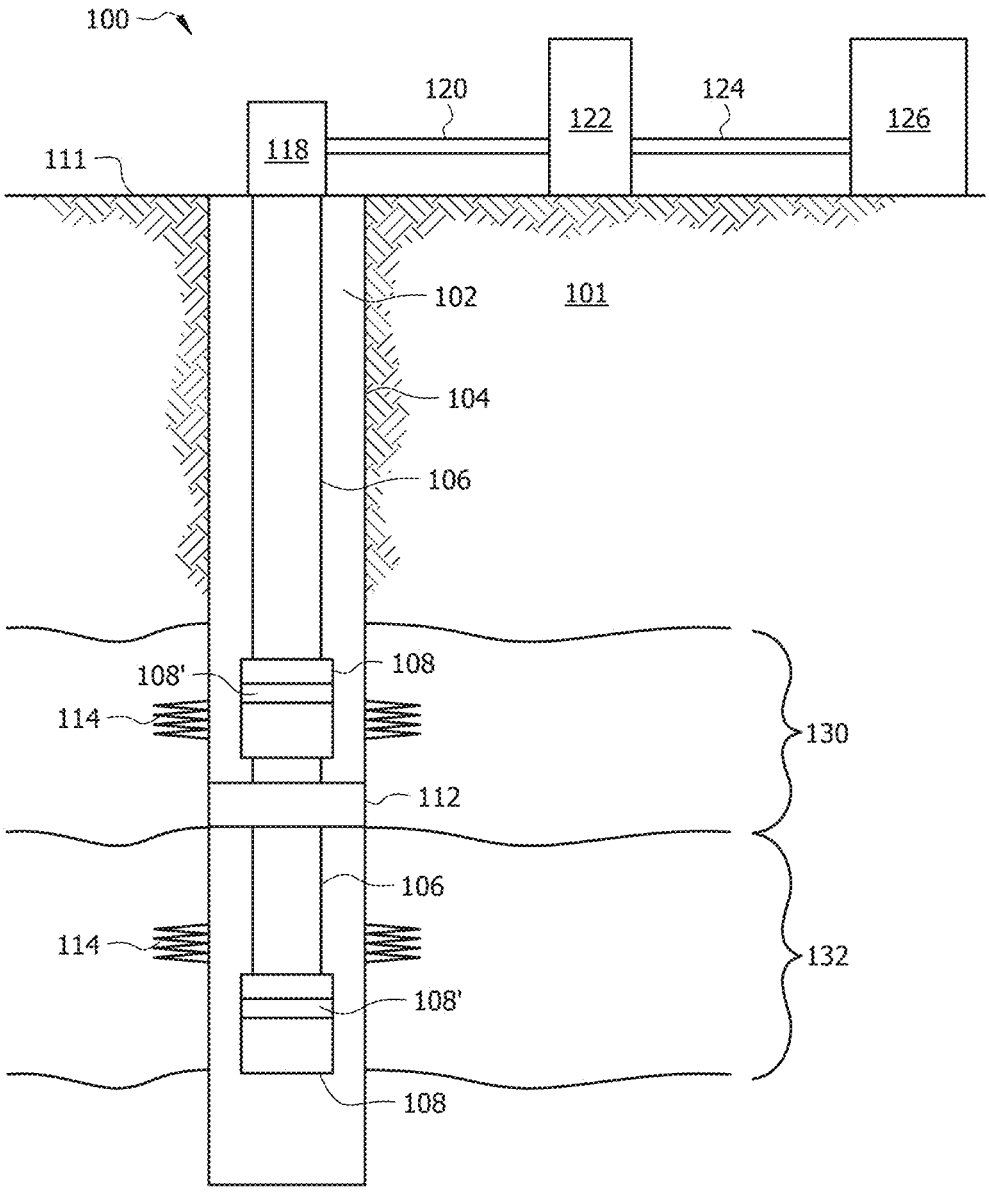
FIG. 2 is a schematic of an example well system, having a production tubing connected with at least one production assembly, in which a magnetic scale inhibitor assembly of this disclosure can be utilized to inhibit scale production, according to embodiments of this disclosure.

FIG. 2 depicts an example well system having a production tubing and at least one flow control device and in which a magnetic scale inhibitor assembly 10 can be positioned (e.g., within a tubular of tubing string 106 or a flow tube 306/402 of a flow control device 108') to inhibit scale production, according to some embodiments. In particular, FIG. 2 is a schematic of a well system 100 that includes a wellbore 102 in a subsurface formation 101. The wellbore 102 includes casing 104 and number of perforations 114 being made in the casing 104. Each set of perforations 114 is located in a respective reservoir 130, 132 to allow reservoir fluids (i.e., oil, water, and gas) from the respective reservoirs 130, 132 to flow into the wellbore 102 and into the tubular string 106 (the production tubing). The tubular string 106 includes a packer 112 that may prevent the comingling of fluids produced from the reservoirs 130, 132 in the wellbore 102. A production assembly 108 may allow the inflow of fluid produced from the reservoir 130 into the tubular string 106, and can include one or more inflow control devices 108'. Likewise, a production assembly 108 may allow the inflow of fluid produced from the reservoir 132 into the tubular string 106.

As noted herein, the production assemblies 108 may include flow control devices 108'. A magnetic scale inhibitor assembly 10 of this disclosure can be positioned in one or more (e.g., each) of the flow control devices 108', and/or in one or more tubulars 206 (FIG. 3) of tubular string 106 to inhibit the production of scale from the water produced from the reservoirs 130, 132 (as further described below). The flow control devices 108' may be configured with flow restrictors such as an inflow tube, a vortex, a fluidic diode, a nozzle, a Tesla valve, a fluidic oscillator, a static mixer, a steam valve, a puck, etc. to restrict flow as fluid 26 flows into the tubular string 106. In some embodiments, the production assemblies 108 may also include a screen (e.g., screen 208, FIG. 3).

A flowline 120 coupled to the wellhead 118 of wellbore 102 and a separator 122 may allow the fluid produced up the tubular string 106 to flow to the separator 122. The separator 122 may be designed to separate the phases of the fluid produced from the wellbore 102. For instance, oil, water, and gas may be separated from each other after passing through the separator 122. The aggregate of fluid (e.g., fluid 26) produced from wellbore 102 may then flow to a tank battery, via flowline 124, that may include components such as storage tank 126, to store the produced fluid.

Figure 3:
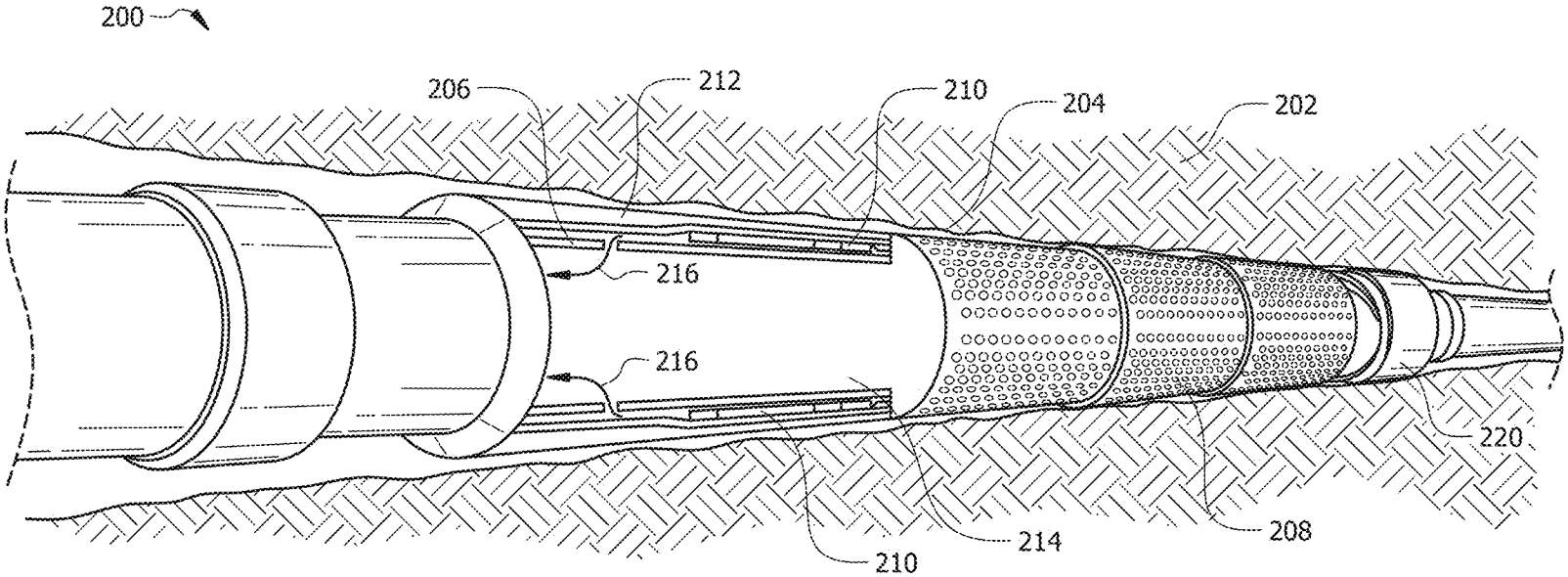
FIG. 3 is a schematic of an example production assembly, in which a magnetic scale inhibitor assembly of this disclosure can be utilized to inhibit scale production, according to embodiments of this disclosure.

FIG. 3 depicts an example production assembly system, according to some embodiments. In particular, FIG. 3 is a schematic of a production assembly 200 (such as production assemblies 108 of FIG. 2) positioned on a tubular string 206 in a wellbore 204 in a subsurface formation 202. Formation fluid (e.g., 26) produced from the subsurface formation 202 may flow into the wellbore 204. To flow into the internal bore 214 of the tubular string 206, fluid may first flow through a screen 208 (i.e., a wire mesh screen enclosed in a perforated shroud). The fluid may then flow through an annular region 210 formed between the outer diameter of the tubular string 206 and a shroud 212, and into the internal bore 214 of the tubular string 206 via ports 216 on the tubular string 206. The annular region 210 may include a flow restrictor to increase the flow velocity of the fluid as it flows through the annular region 210. A magnetic scale inhibitor assembly 10 of this disclosure can, in embodiments, be positioned between screen 208 and flow control device 108' (e.g., between screen 208 and a flow restrictor of flow control device 108'). For example, in embodiments, a magnetic scale inhibitor assembly 10 of this disclosure can be positioned proximate the annular region 210 to utilize the high flow velocity for inhibition of the production of scale as the fluid 26 passes through the annular region 210. In embodiments, the magnetic scale inhibitor assembly 10 of this disclosure may be positioned in the annular region 210 at a position that is either upstream or downstream of the flow restrictor. A packer 220 can be positioned on the tubular string 206 to isolate the fluids produced from a separate reservoir, as described in FIG. 2.

As mentioned hereinabove, in embodiments, a magnetic scale inhibitor 10 of this assembly can be positioned in a flow control device 108' (e.g., in a flow restrictor, such as ICV 300 of FIGS. 4A/4B, described hereinbelow) of a flow control device 108'. For example, the example flow control device 108' can be a part of production assemblies 108 of FIG. 2.

Figure 4A:
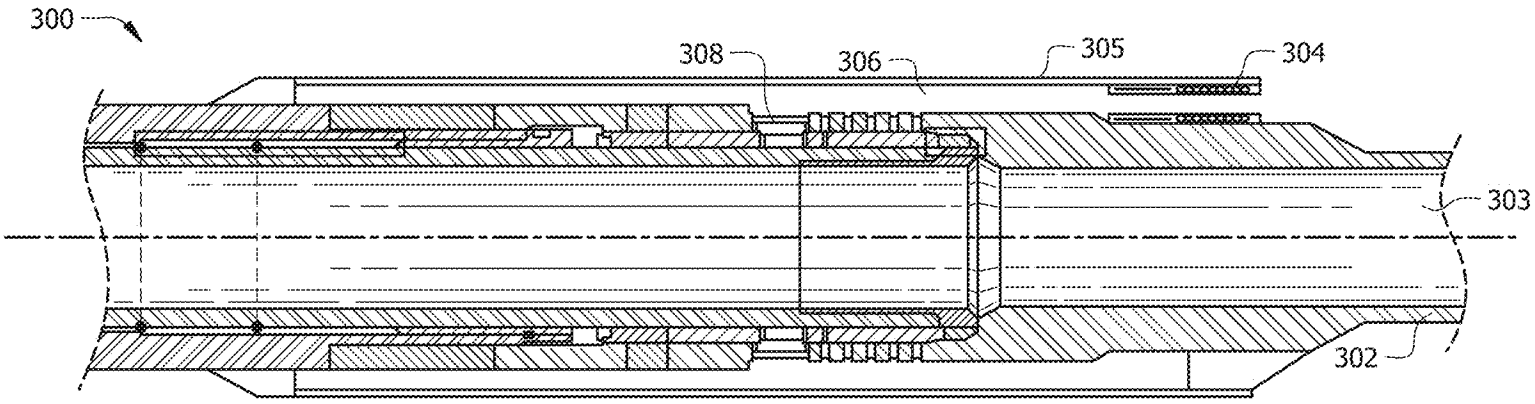
FIG. 4A is a schematic of an example inflow control valve (ICV) in which a magnetic scale inhibitor assembly of this disclosure can be positioned, according to embodiments of this disclosure.
Figure 4B:
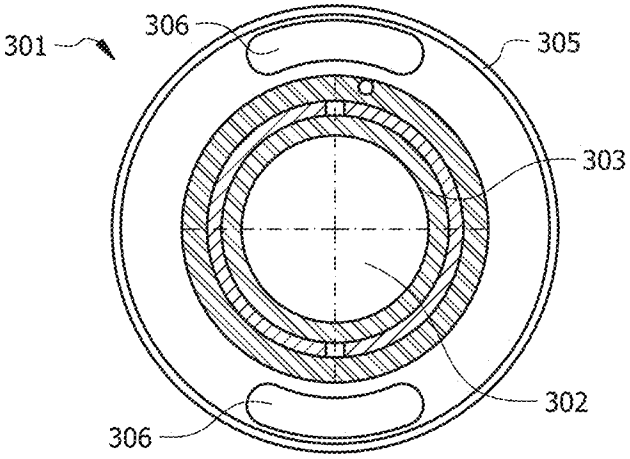
FIG. 4B is a cross section view of the ICV of FIG. 4A.

FIG. 4A depicts an example inflow control valve (ICV), according to some embodiments, and FIG. 4B is a cross section view of the ICV of FIG. 4A. In particular, FIG. 4A includes a schematic of an ICV 300 and FIG. 4B provides a cross-sectional view 301 of ICV 300. ICV 300 includes a base pipe 302 with an internal bore 303. The ICV 300 may be positioned on a base pipe 302. A shroud 305 may be positioned external to the base pipe 302 to form inflow tubes 306 (i.e., a flow restrictor). Ports 308 may allow hydraulic communication between the inflow tubes 306 and the internal bore 303 such that fluid may flow from the inflow tubes 306 and into the internal bore 303. The inflow tubes 306 may be configured such that fluid flow is restricted when flowing from the subsurface formation and into the ICV 300, thus the flow velocity may increase as fluid flows from the wellbore and into the inflow tubes 306. For example, the cross-sectional area of the inflow tube 306 may be less than the cross-sectional area upstream of the inflow tubes 306 (i.e., where the fluid is flowing from, such as the wellbore), resulting in a restriction of the fluid flow and the flow velocity increasing when the fluid enters the inflow tubes 306. A magnetic scale inhibitor assembly 10 of this disclosure may be positioned proximate (e.g., along an inside surface 32 of) one or more of the inflow tubes 306 where there may be an increased flow velocity to maximize the magnetohydrodynamic force applied to the dissolved ions in the fluid, thus inhibiting the production of scale. In the embodiment shown in FIGS. 4A/4B, the magnetic flux generated by the magnetic scale inhibitor assembly 10 (in the second configuration thereof) may be contained within the inflow tube 306 and may not extend beyond the metal of the base pipe 302 and shroud 305. For instance, approximately all (i.e., at least 90%) of the magnetic flux may be contained within the walls of the ICV 300, between the shroud 305 and the base pipe 302 e.g., a flow restrictor such as the inflow tube 306). For example, approximately none of the magnetic flux M generated by the magnetic scale inhibitor assembly 10 (less than 10%) may extend into the internal bore 303 and/or outside the shroud 305 and into the wellbore 102.

Figure 5:
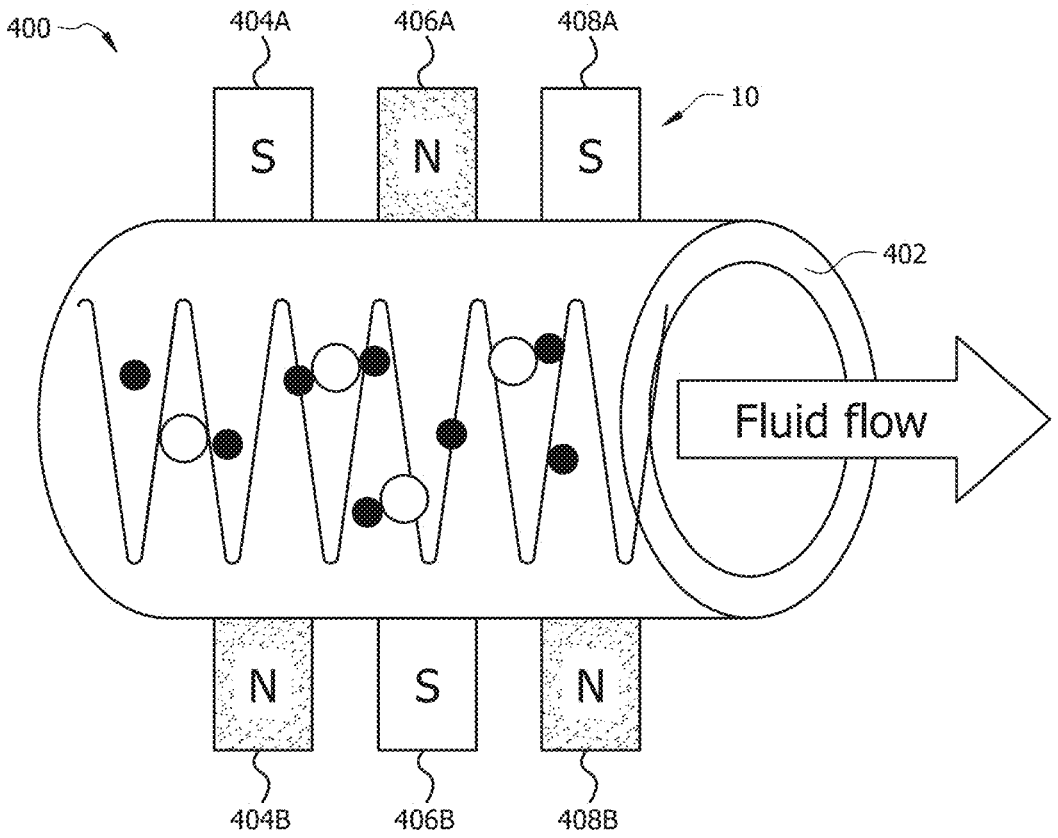
FIG. 5 is a schematic of an example magnetic scale inhibitor positioned on a flow restrictor, according to embodiments of this disclosure.

To help illustrate, FIG. 5 depicts an example magnetic scale inhibitor assembly 10 (in the second configuration) positioned on a flow restrictor, according to embodiments of this disclosure. In particular, FIG. 5 includes a flow restrictor 400 that includes an inflow tube 402. The inflow tube 402 may be similar to the inflow tubes 306 of FIGS. 4A/4B. In such embodiments, flowbore wall 31 can comprise the walls of the inflow tube 402 (or inflow tube 306 of FIGS. 4A/4B). In some embodiments, the inflow tube 402 may be a component of an inflow control device (ICD) 108', such as a nozzle, that may create a pressure drop for balancing production. Magnets 404A, B, 406A, B, and 408A, B of magnetic scale inhibitor assembly 10 can be positioned around the circumference (e.g., outside surface 33) of the inflow tube 402. In some embodiments, the magnets (12, FIG. 1A-1C) may be positioned upstream or downstream of the inflow tube 402. FIG. 5 depicts two rows of magnets, where the azimuthal position of magnets 404A, 406A, and 408A on the inflow tube 402 are approximately 180 degrees about the longitudinal axis of the inflow tube 402 from magnets 404B, 406B, and 408B. In some embodiments, the respective magnet pairs may have a relative azimuthal position greater than or less than 180 degrees. In some embodiments, the magnets along the flow path may flip the magnetic field M as shown in FIG. 5 where the magnetic field direction of magnets 404A, B may be in approximately the opposite direction from the field direction of magnets 406A, B. In some embodiments, the magnets along the flow path may rotate the magnetic field M such as if the field line from magnets 404A, B is approximately 90 degrees from the field lines from magnets 406A, B. In some embodiments, there may be only one row of magnets (e.g., the magnetic scale inhibitor 40 of magnetic scale inhibitor assembly 10 may only include magnets 404A, 406A, and 408A) that may be positioned approximately parallel to the longitudinal axis of the inflow tube 402. In some embodiments there may be more than two rows of magnets. In some embodiments, there may be only one row of magnets positioned approximately parallel to the longitudinal axis of the inflow tube 402 and a ferromagnetic component with an azimuthal position of approximately 180 degrees longitudinal from the row of magnets. In some embodiments, the magnet subsets (i.e., magnets 404A and 404B) may be arranged about the circumference of the inflow tube 402 in various arrays, as described below in FIG. 5. The magnets 404A, B, 406A, B, and 408A, B may be configured to generate an alternating magnetic field M. For example, the configuration of magnet subset 404 A, B may be opposite of the configuration of magnet subset 406 A, B such that the magnet fields generated by each respective magnet subset are opposite each other. As fluid flows through the inflow tube 402 and the alternating magnetic field M, the dissolved ions in the fluid may feel a Lorentz force (magnetohydrodynamic force) from the alternating magnetic field M. In some embodiments, the magnetic field M lines may be approximately perpendicular to the flow direction. In another embodiment, the magnetic field M lines may be approximately parallel to the flow direction (e.g., indicated by arrow A in FIGS. 1A-1C).

Figure 6:
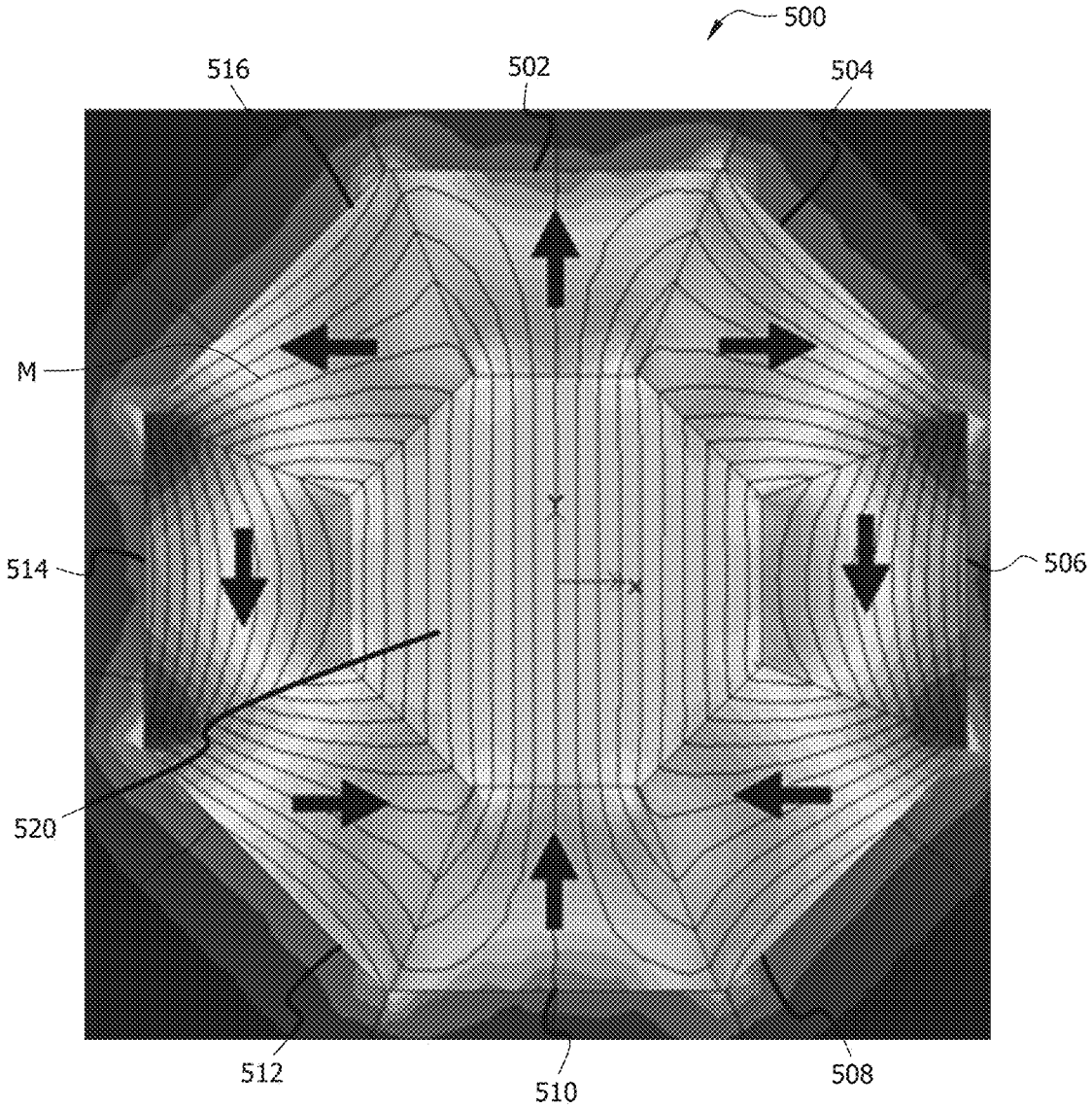
FIG. 6 is a schematic of an example illustration of magnets in a Halbach array, according to some embodiments.

To further illustrate a magnetic scale inhibitor assembly 10 of this disclosure, FIG. 6 depicts an example illustration of a plurality of magnets 12 (comprising magnets 502, 504, 506, 508, 510, 512, 514, 516, in FIG. 6) in a Halbach array, according to some embodiments. A magnet subset 500 (such as magnets 404A,B of FIG. 5) can include magnets 502-516 arranged in a Halbach array. The magnets 502-516 may be arranged in a Halbach array about the circumference of a flowbore wall 31, such as a wall of a (e.g., flow restrictor of a) flow control device 108' or a wall of a portion of a tubular 206 (FIG. 3) of tubular string 106 (FIG. 2). The arrows for each respective magnet 502-516 indicate the direction of the magnetic field M for each magnet 502-516. The Halbach array may create an approximately uniform magnetic field within the interior area 520 (i.e., the flow restrictor). In some embodiments, there may be radial constraints (e.g., within the inflow path of a flow restrictor) that may allow for only a partial Halbach array. For example, magnets 12 may not be placed around the entire circumference 33 of the flowbore wall 31 (e.g., of a flow tube 306 (FIGS. 4A/4B) or 402 (FIG. 5) or tubular (106, FIG. 2, 208, FIG. 3)). In some embodiments, the Halbach array configuration may not be at least partially circular. For example, the Halbach array may be configured to be rectangular, in two parallel planes, etc.

Also provided herein is a method of inhibiting scale in a fluid flow 26. The method comprises flowing, for a first time period t1, a flow of a fluid 26 from a subsurface formation 101 and into a tubular string 106 positioned in a wellbore 102 with a magnetic scale inhibitor assembly 10 configured in a first configuration (e.g., FIG. 1A). The method further comprises, subsequent the first time period t1, flowing the fluid 26 from the subsurface formation 101 and into the tubular string 106 positioned in the wellbore 102 with the magnetic scale inhibitor assembly 10 configured in a second configuration (e.g., FIG. 1B or FIG. 1C). During the first time period t1, the fluid 26 can be predicted to comprise more ferromagnetic particles 27 than subsequent the first time period t1.

The magnetic scale inhibitor assembly 10 is as described hereinabove. For example, the magnetic scale inhibitor assembly 10 comprises: a magnetic scale inhibitor 40 comprising: one or a plurality of magnets 12 positioned proximate a fluid flowbore 30 and configured such that a magnetic flux/magnetic field M produced by the one or more magnets 12 is directed toward the fluid flowbore 30. The fluid flowbore 30 comprises a flowbore 30 of at least a portion of a production tubular 206 of the tubular string 106 or a flowbore 30 of a flow control device 108' upstream from the tubular string 106 and configured for restricting the flow (indicated by arrow A in FIG. 1A) of the fluid 26 from the subsurface formation 101 into the tubular string 106. In the first configuration (e.g., FIG. 1A) of the magnetic scale inhibitor assembly 10, magnet shield 20 comprising barrier 25 is positioned at location L1 between the one or the plurality of magnets 12 of the magnetic scale inhibitor 40 and the fluid flowbore 30 for at least the first time period t1, such that, during at least the first time period t1, the barrier 25 reduces or eliminates passage of the magnetic flux/magnetic field M into the fluid flowbore 30 and attraction of ferromagnetic particles 27 to the one or the plurality of magnets 12/location L1. As described hereinabove: barrier 25 is degradable in the fluid 26, such that, subsequent the first time period t1, the barrier 20 has degraded and is no longer present at the location L1 in a second configuration of the magnetic scale inhibitor assembly 10 (such second configuration depicted and described hereinabove with reference to FIG. 1B); and/or barrier 25 is shiftable, such that, subsequent the first time period t1, the barrier 25 is shifted away from the location L1 in the second configuration of the magnetic scale inhibitor assembly 10 (such second configuration depicted and described hereinabove with reference to FIG. 1C), such that, in the second configuration, the magnetic flux/magnetic field M produced by the one or the plurality magnets 12 is directed into the fluid flowbore 30, whereby any dissolved ions cluster/agglomerate within the flow (indicated by arrow A1 in FIG. 1A) of the fluid 26 and do not gather along a flowbore wall 31 defining the flowbore 30.

In the second configuration of the magnetic scale inhibitor assembly 10 (as depicted in FIG. 1B and FIG. 1C), the magnetic scale inhibitor 40 produces the magnetic field M extending into flowbore 30 through which the fluid 26 flows. The magnetic scale inhibitor 40 can be as described hereinabove. For example, in embodiments, the magnetic field M can comprise an alternating magnetic field. The one or the plurality of magnets 12 can be positioned proximate (e.g., about an exterior circumference 33 of) the flowbore walls 31 that define the flowbore 30. For example, the one or the plurality of magnets 12 can be positioned proximate (e.g., about an exterior circumference 33 of) of (e.g., at least a portion of) a production tubular 206 of the tubular string 106, and/or the one or the plurality of magnets 12 can be positioned proximate the flowbore walls 31 of an inflow tube 306/402 of (e.g., a flow restrictor of) a flow control device 108'. In embodiments, the magnetic scale inhibitor 40 comprises the plurality of magnets 12, and the plurality magnets 12 are positioned around a circumference 33 of a flowbore wall 31 defining the flowbore 30 in at least a partial Halbach array.

The removeable (e.g., degradable and/or shiftable) magnet shield 20 of this disclosure can be utilized to protect the one or more (e.g., permanent) magnets 12 of a magnetic scale inhibitor 40, for example, during wellbore installation and startup. The scale-inhibiting magnets 12 can either direct the magnetic flux M thereof into the inside diameter (e.g., the flowbore 30) of a tubing (e.g., a portion of a tubular 206 of a tubular string 106) or can direct the magnetic flux M thereof into the inflow into the production tubing (e.g., into an inflow tube 306 (FIGS. 4A/4B)/402 (FIG. 5) of an inflow control device 108').

The removeable magnet shield 20 prevents the ferromagnetic particles 27 in the fluid 26 from sticking to the section 31' of the flowbore wall 31 having the permanent magnet(s) 12 thereon during a first time period t1, when ferromagnetic particles 27 may be expected in the fluid 26. During production, the magnet shield 20 can disappear (e.g., dissolve or otherwise degrade and/or shift) which allows the magnetic flux M of the magnet(s) 12 to flow through the flow paths in the flowbore 30 and to minimize scale production. In embodiments, the magnet shield 20 can disappear by dissolving in the fluid 26 or it can be removed by sliding (e.g., shifting) out of the way (e.g., out of the path of the magnetic field M).

Via this disclosure, one or a plurality of magnets 12 (e.g., an array 11 of magnets 12) can be utilized to minimize the likelihood of producing scale that can stick to the inside diameter 32 of a flowbore wall 31 (e.g., an inside surface 32 of a production tubing 206). Scale is generally formed from dissolved ions coming out of solution. These ions have a charge that is influenced by a magnetic field M. The operating principle of the magnetic scale inhibitor 40 of the magnetic scale inhibitor assembly 10 of this disclosure is that the magnetohydrodynamic forces help encourage $CaCO_3$ to form aragonite which does not stick to the flowbore wall 31, rather than calcite and vaterite, which do stick to the flowbore wall 31. Similar protection can be provided with $CaSO_4$, $BaSO_4$ and asphaltenes.

Via this disclosure, a degradable or shiftable magnet shield 20 is employed to prevent iron particles from collecting around the magnet(s) 12 of a magnetic scale inhibitor 40. The additional distance from the magnet(s) 12 allows swarf to be carried away by the production fluid 26, rather than sticking to the section 31' of the flowbore wall 31 proximate the magnet(s) 12. As described herein, the magnet shield 20 can be held in place with an affixing component 21, such as a collet, a snap ring, a set screw, adhesive, shear pin, as a liner on the pipe, etc. As swarf/ferromagnetic particles 27 may only be expected in the fluid 26 early in the life of the wellbore 101, there will be no more swarf 27 of concern by the time (e.g., the end of first time period t1) that the magnet shield has degraded (e.g., dissolved) and/or shifted away from location L1. The degradable and/or shiftable magnet shield 20 provides sufficient distance (e.g., distance of at least D between the one or more magnets 12 and the ferromagnetic particles 27 in the fluid 26), such that few particles 27 of steel swarf will accumulate by the permanent magnet(s) 12. The magnet array 11 (e.g., the arrangement of the one or the plurality of magnets 12) can be linear or cylindrical.

Additional Disclosure

The following are non-limiting, specific embodiments in accordance with the present disclosure:

In a first embodiment a magnet shield for use with a magnetic scale inhibitor comprises: a barrier configured for positioning at a location between the magnetic scale inhibitor and a fluid flowbore for at least a first time period, wherein the flowbore is configured for flow of a fluid, and wherein the barrier is: degradable in the fluid, such that, after the first time period, the barrier is no longer present at the location; and/or shiftable, such that, after the first time period, the barrier can be shifted away from the location, wherein, during the first time period, the barrier reduces or eliminates attraction of ferromagnetic particles to magnets of the magnetic scale inhibitor.

A second embodiment can include the magnet shield of the first embodiment, wherein the barrier comprises a cylindrical sleeve positioned in a production tubular of a tubular string (also referred to herein as a "production string) or an inflow tube upstream of the tubular string.

A third embodiment can include the magnet shield of the second embodiment, further comprising an affixing component operable to hold the cylindrical sleeve in place on a flowbore wall of the production tubing or the inflow tube, wherein the affixing component is selected from snap rings, collets, set screws, adhesives, shear pins, liners providing the cylindrical sleeve on the flowbore wall, or a combination thereof.

A fourth embodiment can include the magnet shield of the third embodiment, wherein the barrier is degradable via dissolution, via hydrolysis, via (e.g., cracking and) breaking into pieces and flowing with the fluid, via chemical reaction, or a combination thereof.

A fifth embodiment can include the magnet shield of the fourth embodiment, wherein the barrier comprises a material selected from polymers, metals, ionic compounds, or a combination thereof.

A sixth embodiment can include the magnet shield of the fifth embodiment, wherein the material comprises a (e.g., degradable) polymer.

A seventh embodiment can include the magnet shield of any one of the fifth or the sixth embodiments, wherein the degradable polymer comprises a degradable plastic (e.g., aliphatic polyesters, such as polyglycolic acid (PGA) and polylactic acid (PLA), acetate, polyvinyl alcohol (PVA), polyvinyl alcohol (PVOH), polylactic acid from L-lactide (PLLA)), a degradable elastomer (e.g., polyurethane, thermoplastic urethane, thiol, natural rubber), sugar, or a combination thereof.

An eighth embodiment can include the magnet shield of any one of the fifth to seventh embodiments, wherein the material comprises a metal selected from magnesium alloys, aluminum alloys, or a combination thereof.

A ninth embodiment can include the magnet shield of the eighth embodiment, wherein the metal is doped with another metal to accelerate a rate of degradation of the barrier/magnet shield.

A tenth embodiment can include the magnet shield of any one of the fifth to ninth embodiments, wherein the material comprises an ionic compound selected from salts (e.g., sodium chloride (NaCl), sodium sulfate ($Na_2SO_4$), barium nitrate ($Ba(NO_3)_2$), borate-compounds, etc.).

An eleventh embodiment can include the magnet shield of any one of the first to tenth embodiments, wherein the barrier is shiftable.

A twelfth embodiment can include the magnet shield of the eleventh embodiment, wherein the barrier is shiftable via a shifting device selected from dart, a ball, a shifting tool, or a combination thereof.

A thirteenth embodiment can include the magnet shield of any one of the first to twelfth embodiments, wherein the barrier is degradable and shiftable.

A fourteenth embodiment can include the magnet shield of any one of the first to thirteenth embodiments, wherein the barrier is shiftable and can be shifted back to the location for a second time period (e.g., for cleaning scale/detritus off the magnetic scale inhibitor or during a cleanup run that produces swarf).

A fifteenth embodiment can include the magnet shield of any one of the first to fourteenth embodiments, wherein the first time period is from about 1 hour to about 1 year (e.g., about 1 month).

In a sixteenth embodiment, a magnetic scale inhibitor assembly comprises: a magnetic scale inhibitor comprising: one or a plurality of magnets positioned proximate a fluid flowbore and configured such that a magnetic flux produced by the one or the plurality of magnets is directed into the fluid flowbore, wherein the fluid flowbore is configured for flow of a fluid; and in a first configuration of the magnetic scale inhibitor assembly, a magnet shield comprising a barrier positioned at a location between the one or the plurality of magnets of the magnetic scale inhibitor and the fluid flowbore for at least a first time period, such that, during the first time period, the barrier reduces or eliminates attraction of ferromagnetic particles to the one or the plurality of magnets/location L1 by reducing or eliminating an amount of the magnetic flux extending into the flowbore, wherein the barrier is: degradable in the fluid, such that, after the first time period, the barrier is no longer present at the location in a second configuration of the magnetic scale inhibitor assembly; and/or shiftable, such that, after the first time period, the barrier can be shifted away from the location in the second configuration of the magnetic scale inhibitor assembly.

A seventeenth embodiment can include the magnetic scale inhibitor assembly of the sixteenth embodiment, wherein the fluid flowbore comprises at least a portion of a flowbore of a production tubular of a tubular string or a flowbore of an inflow tube upstream from the tubular string.

An eighteenth embodiment can include the magnetic scale inhibitor assembly of the seventeenth embodiment, wherein the inflow tube is part of a flow control device upstream of the tubular string.

A nineteenth embodiment can include the magnetic scale inhibitor assembly of the eighteenth embodiment, wherein the fluid flowbore comprises a fluid flowbore of a restrictor of the flow control device.

A twentieth embodiment can include the magnetic scale inhibitor assembly of any one of the eighteenth or nineteenth embodiments, wherein the flow control device is configured to increase a flow velocity of the fluid as the fluid flows through the flow control device, and wherein the flow control device comprises a nozzle, a vortex, a Tesla valve, a fluidic oscillator, a puck, a static mixer, or a steam valve.

A twenty first embodiment can include the magnetic scale inhibitor assembly of any one of the sixteenth to twentieth embodiments, wherein the magnetic scale inhibitor is configured to create a magnetic field through which the fluid is to flow along the flowbore when the magnetic scale inhibitor assembly is in the second configuration.

A twenty second embodiment can include the magnetic scale inhibitor assembly of the twenty first embodiment, wherein the magnetic field comprises an alternating magnetic field.

A twenty third embodiment can include the magnetic scale inhibitor assembly of any one of the sixteenth to twenty second embodiments, comprising the plurality of magnets.

A twenty fourth embodiment can include the magnetic scale inhibitor assembly of the twenty third embodiment, wherein the plurality of magnets are positioned proximate at least a portion of a production tubing of a tubular string or a flow tube (e.g., a flow restrictor) of a flow control device upstream from the tubular string.

A twenty fifth embodiment can include the magnetic scale inhibitor assembly of any one of the sixteenth to twenty fourth embodiments, wherein the plurality of magnets are positioned around a circumference of the at least the portion of the production tubing or the flow tube of the flow control device in at least a partial Halbach array.

A twenty sixth embodiment can include the magnetic scale inhibitor assembly of any one of the sixteenth to twenty fifth embodiments, wherein the magnetic scale inhibitor is configured to generate a magnetohydrodynamic force in the fluid as the fluid flows through the flowbore when the magnetic scale inhibitor assembly is in the second configuration.

A twenty seventh embodiment can include the magnetic scale inhibitor assembly of the twenty sixth embodiment, wherein the fluid comprises dissolved ions that, in response to the magnetohydrodynamic force, are clustered/aggregated in the fluid flow and do not gather along a flowbore wall defining the flowbore.

In a twenty eighth embodiment, a method comprises: flowing, for a first time period, a flow of a fluid from a subsurface formation and into a tubular string positioned in a wellbore with a magnetic scale inhibitor assembly configured in a first configuration; and subsequent the first time period, flowing the fluid from the subsurface formation and into the tubular string positioned in the wellbore with the magnetic scale inhibitor assembly configured in a second configuration, wherein during the first time period the fluid is predicted to comprise more ferromagnetic particles than subsequent the first time period, wherein the magnetic scale inhibitor assembly comprises: a magnetic scale inhibitor comprising: one or a plurality of magnets positioned proximate a fluid flowbore and configured such that a magnetic flux/magnetic field produced by the one or more magnets is directed toward the fluid flowbore, wherein the fluid flowbore comprises a flowbore of at least a portion of a production tubular of the tubular string or a flowbore of a flow control device upstream from the tubular string and configured for restricting the flow of the fluid from the subsurface formation into the tubular string; and in the first configuration of the magnetic scale inhibitor assembly, a magnet shield comprising a barrier positioned at a location between the one or the plurality of magnets of the magnetic scale inhibitor and the fluid flowbore for at least the first time period, such that, during at least the first time period, the barrier reduces or eliminates passage of the magnetic flux/magnetic field into the fluid flowbore and attraction of ferromagnetic particles to the one or the plurality of magnets/location, wherein the barrier is: degradable in the fluid, such that, subsequent the first time period, the barrier is no longer present at the location in a second configuration of the magnetic scale inhibitor assembly, and/or shiftable, such that, subsequent the first time period, the barrier is shifted away from the location in the second configuration of the magnetic scale inhibitor, such that, in the second configuration, the magnetic flux/magnetic field produced by the one or the plurality magnets is directed into the fluid flowbore, whereby dissolved ions cluster/agglomerate within the flow of the fluid and do not gather along a flowbore wall defining the flowbore.

A twenty ninth embodiment can include the method of the twenty eighth embodiment, wherein, in the second configuration of the magnetic scale inhibitor assembly, the magnetic scale inhibitor produces the magnetic field through which the fluid flows.

A thirtieth embodiment can include the method of the twenty eighth or the twenty ninth embodiment, wherein the magnetic field comprises an alternating magnetic field.

A thirty first embodiment can include the method of any one of the twenty eighth to thirtieth embodiments, wherein the one or the plurality of magnets are positioned proximate (e.g., about an exterior circumference of) the flowbore of the production tubular of the tubular string.

A thirty second embodiment can include the method of any one of the twenty eighth to thirty first embodiments, wherein the one or the plurality of magnets are positioned proximate the flowbore of a flow restrictor of the flow control device.

A thirty third embodiment can include the method of any one of the twenty eighth to thirty second embodiments, wherein the magnetic scale inhibitor comprises the plurality of magnets, and wherein the plurality magnets are positioned around a circumference of a flowbore wall defining the flowbore in at least a partial Halbach array.

In a thirty forth embodiment, a method comprises: (a) shielding (e.g., with a shield) a magnetic field produced by magnets disposed within a scale inhibitor tool for a first period of time (e.g., during a startup time when an enhanced or increased presence of ferromagnetic particles, for example particles resulting from a wellbore operation such a milling an opening for a lateral wellbore in a casing or other tubing, is expected in fluid flowing through the scale inhibitor tool); and (b) after the first period of time, unshielding the magnetic flied produced by the scale inhibitor tool (e.g., by removing all or a portion of the shield positioned adjacent/between the magnets and an internal flow bore of the scale inhibitor tool, by shifting/axially moving all or a portion of the shield from a position adjacent/between the magnets and the internal flow bore of the scale inhibitor tool, or both).

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=R1+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

What is claimed is:

1. A magnet shield for use with a magnetic scale inhibitor, the magnet shield comprising:

a barrier configured for positioning at a location between the magnetic scale inhibitor and a fluid flowbore for at least a first time period, wherein the flowbore is configured for flow of a fluid, and wherein the barrier is:

degradable in the fluid, such that, after the first time period, the barrier is no longer present at the location; and/or shiftable, such that, after the first time period, the barrier can be shifted away from the location, wherein, during the first time period, the barrier reduces or eliminates attraction of ferromagnetic particles to magnets of the magnetic scale inhibitor.

2. The magnet shield of claim 1, wherein the barrier comprises a cylindrical sleeve positioned in a production tubular of a tubular string or an inflow tube upstream of the tubular string.

3. The magnet shield of claim 2, further comprising an affixing component operable to hold the cylindrical sleeve in place on a flowbore wall of the production tubing or the inflow tube, wherein the affixing component is selected from snap rings, collets, set screws, adhesives, shear pins, liners providing the cylindrical sleeve on the flowbore wall, or a combination thereof.

4. The magnet shield of claim 3, wherein the barrier is degradable via dissolution, via hydrolysis, via breaking into pieces and flowing with the fluid, via chemical reaction, or a combination thereof.

5. The magnet shield of claim 1, wherein the barrier is shiftable.

6. The magnet shield of claim 5, wherein the barrier is shiftable via a shifting device selected from dart, a ball, a shifting tool, or a combination thereof.

7. The magnet shield of claim 1, wherein the barrier is degradable and shiftable.

8. The magnet shield of claim 1, wherein the barrier is shiftable and can be shifted back to the location for a second time period.

9. A magnetic scale inhibitor assembly comprising:

a magnetic scale inhibitor comprising: one or a plurality of magnets positioned proximate a fluid flowbore and configured such that a magnetic flux/magnetic field produced by the one or the plurality of magnets is directed into the fluid flowbore, wherein the fluid flowbore is configured for flow of a fluid; and in a first configuration of the magnetic scale inhibitor assembly, a magnet shield comprising a barrier positioned at a location between the one or the plurality of magnets of the magnetic scale inhibitor and the fluid flowbore for at least a first time period, such that, during the first time period, the barrier reduces or eliminates attraction of ferromagnetic particles toward the one or the plurality of magnets by reducing or eliminating an amount of the magnetic flux/magnetic field extending into the flowbore, wherein the barrier is:

degradable in the fluid, such that, after the first time period, the barrier is no longer present at the location in a second configuration of the magnetic scale inhibitor assembly; and/or shiftable, such that, after the first time period, the barrier can be shifted away from the location in the second configuration of the magnetic scale inhibitor assembly.

10. The magnetic scale inhibitor assembly of claim 9, wherein the fluid flowbore comprises at least a portion of a flowbore of a production tubular of a tubular string or a flowbore of an inflow tube upstream from the tubular string.

11. The magnetic scale inhibitor assembly of claim 10, wherein the inflow tube is part of a flow control device upstream of the tubular string.

12. The magnetic scale inhibitor assembly of claim 11, wherein the fluid flowbore comprises a fluid flowbore of a restrictor of the flow control device.

13. The magnetic scale inhibitor assembly of claim 11, wherein the flow control device is configured to increase a flow velocity of the fluid as the fluid flows through the flow control device, and wherein the flow control device comprises a nozzle, a vortex, a Tesla valve, a fluidic oscillator, a puck, a static mixer, or a steam valve.

14. The magnetic scale inhibitor assembly of claim 9, wherein the magnetic scale inhibitor is configured to create a magnetic field through which the fluid is to flow along the flowbore when the magnetic scale inhibitor assembly is in the second configuration.

15. The magnetic scale inhibitor assembly of claim 14, wherein the magnetic field comprises an alternating magnetic field.

16. The magnetic scale inhibitor assembly of claim 9, comprising the plurality of magnets.

17. The magnetic scale inhibitor assembly of claim 16, wherein the plurality of magnets are positioned proximate at least a portion of a production tubing of a tubular string or a flow tube of a flow control device upstream from the tubular string.

18. A method comprising:

flowing, for a first time period, a flow of a fluid from a subsurface formation and into a tubular string positioned in a wellbore with a magnetic scale inhibitor assembly configured in a first configuration; and subsequent the first time period, flowing the fluid from the subsurface formation and into the tubular string positioned in the wellbore with the magnetic scale inhibitor assembly configured in a second configuration, wherein during the first time period the fluid is predicted to comprise more ferromagnetic particles than subsequent the first time period, wherein the magnetic scale inhibitor assembly comprises:

a magnetic scale inhibitor comprising: one or a plurality of magnets positioned proximate a fluid flowbore and configured such that a magnetic flux/magnetic field produced by the one or more magnets is directed toward the fluid flowbore, wherein the fluid flowbore comprises a flowbore of at least a portion of a production tubular of the tubular string or a flowbore of a flow control device upstream from the tubular string and configured for restricting the flow of the fluid from the subsurface formation into the tubular string; and in the first configuration of the magnetic scale inhibitor assembly, a magnet shield comprising a barrier positioned at a location between the one or the plurality of magnets of the magnetic scale inhibitor and the fluid flowbore for at least the first time period, such that, during at least the first time period, the barrier reduces or eliminates passage of the magnetic flux/magnetic field into the fluid flowbore and attraction of ferromagnetic particles to the one or the plurality of magnets/location, wherein the barrier is:

degradable in the fluid, such that, subsequent the first time period, the barrier is no longer present at the location in a second configuration of the magnetic scale inhibitor assembly;

and/or shiftable, such that, subsequent the first time period, the barrier is shifted away from the location in the second configuration of the magnetic scale inhibitor, such that, in the second configuration, the magnetic flux/magnetic field produced by the one or the plurality magnets is directed into the fluid flowbore, whereby dissolved ions cluster/agglomerate within the flow of the fluid and do not gather along a flowbore wall defining the flowbore.

19. The method of claim 18, wherein, in the second configuration of the magnetic scale inhibitor assembly, the magnetic scale inhibitor produces the magnetic field through which the fluid flows.

20. The method of claim 18, wherein the magnetic field comprises an alternating magnetic field.

* * * * *